US006269233B1

(12) United States Patent
Yamaguchi

(10) Patent No.: US 6,269,233 B1
(45) Date of Patent: Jul. 31, 2001

(54) LIQUID DEVELOPER IMAGING APPARATUS HAVING EXTENDED PHOTO-CONDUCTOR LIFE

(75) Inventor: Chiseki Yamaguchi, Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/656,751

(22) Filed: Sep. 7, 2000

(30) Foreign Application Priority Data

Sep. 13, 1999 (JP) ..... 11-258706

(51) Int. Cl.[7] ..... G03G 15/10
(52) U.S. Cl. ..... 399/237; 399/164; 399/250
(58) Field of Search ..... 399/237, 233, 399/162, 165, 164, 249, 250

(56) References Cited

U.S. PATENT DOCUMENTS

| | | | | |
|---|---|---|---|---|
| 5,291,251 | * | 3/1994 | Storlie et al. | 399/223 |
| 5,650,253 | | 7/1997 | Baker et al. . | |
| 5,698,616 | | 12/1997 | Baker et al. . | |
| 5,887,219 | * | 3/1999 | Eom | 399/45 |
| 6,047,151 | * | 4/2000 | Carvalho et al. | 399/250 |

FOREIGN PATENT DOCUMENTS

| | | |
|---|---|---|
| 4-35161 | 3/1992 | (JP) . |
| 4-181961 | 6/1992 | (JP) . |
| 6-35273 | 2/1994 | (JP) . |
| 2701768 | 10/1997 | (JP) . |

* cited by examiner

*Primary Examiner*—Quana M. Grainger
(74) *Attorney, Agent, or Firm*—McGinn & Gibb, PLLC

(57) ABSTRACT

An image forming apparatus using a liquid developer, which can be used for a long time without considering a swelling of a photoconductor material caused by the liquid developer and a heating characteristic of the photo-conductor material, is provided. The image forming apparatus used a liquid developers provides an electrostatic latent image forming unit, a charging means for charging the electrostatic latent image forming unit, a latent image forming means for forming an electrostatic latent image on the electrostatic latent image forming unit, a belt type developed image carrier which rotates in a state that a part of the inside surface of the belt type developed image contacts firmly with the latent image forming unit, an electrostatically image transferring means for electrostatically transferring the electrostatic latent image formed on the electrostatic latent image forming unit to the belt type developed image carrier, a developing means for developing the electrostatic latent image transferred on the belt type developed image carrier by transporting a liquid developer to the belt type developed image carrier, a squeezing means for squeezing the residual liquid developer from the developed image on the belt type developed image carrier by applying pressure, a vaporizing means for vaporizing the liquid developer contained in the developed image on the belt type developed image carrier by applying heat and pressure, and a transferring/fixing means for transferring and fixing on a recording medium the developed image after the residual liquid developer was squeezed and vaporized.

21 Claims, 6 Drawing Sheets

LIQUID DEVELOPER IMAGING APPARATUS HAVING EXTENDED PHOTO-CONDUCTOR LIFE

BACKGROUND OF THE INVENTION

The present invention relates to an image forming apparatus used a liquid developer, in particular, which can be used for a long time without causing a swelling of a photo-conductor material caused by the liquid developer and a heating characteristic of the photo-conductor material.

Description of the Related Art

Japanese Patent Application Laid-Open No. HEI 4-181961 discloses an electrophotographic apparatus, Japanese Utility Model Application Laid-Open No. HEI 4-35161 discloses an image forming apparatus, and Japanese Patent No. 2701768 discloses an image forming apparatus. In these apparatuses, an electrostatic latent image formed on a photo-conductor unit is transferred to such as a film electrostatically, and the transferred electrostatic latent image is developed. And further, in these apparatuses, the film is contacted firmly with the photo-conductor unit on which the electrostatic latent image is formed, and after this, powder development is applied to the transferred image. However, there is a problem that transferring the electrostatic latent image to the film is not performed sufficiently by only contacting the film firmly with the photo-conductor unit. And further, there is another problem that it is difficult to realize an image had high resolution by applying the powder development.

And Japanese Patent Application Laid-Open No. HEI 6-35273 discloses an image forming apparatus. In this apparatus, a film is contacted firmly on a photo-conductor unit, and after this, the photo-conductor unit is exposed. However, in this apparatus, the film is required to have transparency, and there is a problem that a characteristic of the transparency is changed by contacting the developer, and in resulting with, reliability is deteriorated.

In order to solve these problems, by using a liquid developer in which charged toner particles are contained in a carrier solvent, an image made of toners is formed on a developed image carrier, and after this, the carrier solvent in the developed image is removed and the image is transferred and fixed on a recording medium. This image forming apparatus used the liquid developer has been realized. At this image forming apparatus, a clear image can be obtained because the toner particles in the liquid developer are small.

However, in the conventional image forming apparatuses used the liquid developer, at the time when the developed image is transferred and fixed on the recording medium, squeezing and drying processes are required to remove the carrier solvent in the developed image. And the photo-conductor unit is a carrier for an electrostatic latent image and a developed image, and the developed image is formed directly on the photo-conductor unit. Therefore, there is a problem that the photo-conductor unit is required to have characteristics such as preventing from swelling, having heat-resistant, and being a long life.

SUMMARY OF THE INVENTION

It is therefore an objective of the present invention to provide an image forming apparatus used a liquid developer which can be used for a long time without causing a swelling of a photo-conductor material caused by the liquid developer and a heating characteristic of the photo-conductor material.

According to a first aspect of the present invention, for achieving the objects mentioned above, there is provided an image forming apparatus used a liquid developer. The image forming apparatus provides an electrostatic latent image forming unit and a belt type developed image carrier which rotates in a state that a part of the inside surface of the belt type developed image carrier contacts firmly with the latent image forming unit. And an electrostatic latent image is transferred to the belt type developed image carrier from the electrostatic latent image forming unit, and the electrostatic latent image transferred on the belt type developed image carrier is developed by a liquid developer.

According to a second aspect of the present invention, an image forming apparatus used a liquid developer provides an electrostatic latent image forming unit, a charging means for charging the electrostatic latent image forming unit, a latent image forming means for forming an electrostatic latent image on the electrostatic latent image forming unit, a belt type developed image carrier which rotates in a state that a part of the inside surface of the belt type developed image contacts firmly with the latent image forming unit, an electrostatically image transferring means for electrostatically transferring the electrostatic latent image formed on the electrostatic latent image forming unit to the belt type developed image carrier, a developing means for developing the electrostatic latent image transferred on the belt type developed image carrier by transporting a liquid developer to the belt type developed image carrier, a squeezing means for squeezing a residual liquid developer from the developed image on the belt type developed image carrier by applying pressure, a vaporizing means for vaporizing the residual liquid developer contained in the developed image on the belt type developed image carrier by applying heat and pressure, and a transferring/fixing means for transferring and fixing on a recording medium the developed image after the residual liquid developer was squeezed and vaporized.

According to a third aspect of the present invention, in the second aspect, the vaporizing means provides a heating unit for applying heat and a drying roller for applying pressure, and the heating unit faces the drying roller by having the belt type developed image carrier between them.

According to a fourth aspect of the present invention, in the second aspect, the transferring/fixing means provides a heating unit for applying heat and a transferring/fixing roller for applying pressure, and the heating unit faces the transferring/fixing roller by having the belt type developed image carrier between them.

According to a fifth aspect of the present invention, in the second aspect, the image forming apparatus used the liquid developer further provides a heating/sustaining component which provides the heating unit in the vaporizing means and the heating unit for the transferring/fixing means and also sustains the rotation of the belt type developed image carrier.

According to a sixth aspect of the present invention, in the second aspect, the image forming apparatus used the liquid developer further provides a heating/sustaining component which provides the heating unit for the transferring/fixing means and also sustains the rotation of the belt type developed image carrier.

According to a seventh aspect of the present invention, in the second aspect, the developing means develops the electrostatic latent image formed on the belt type developed image carrier at the reverse surface of the surface that the belt type developed image carrier contacts with the electrostatic latent image forming unit.

According to an eighth aspect of the present invention, in the second aspect, the developing means and the squeezing means are disposed at the position where the inside surface of the belt type developed image carrier contacts firmly with the electrostatic latent image forming unit, and the vaporizing means is disposed at the position where the inside surface of the belt type developed image carrier does not contact firmly with the electrostatic latent image forming unit.

According to a ninth aspect of the present invention, in the second aspect, the developing means is disposed at the position where the inside surface of the belt type developed image carrier contacts firmly with the electrostatic latent image forming unit, and the squeezing means and the vaporizing means are disposed at the position where the inside surface of the belt type developed image carrier does not contact firmly with the electrostatic latent image forming unit.

According to a tenth aspect of the present invention, in the second aspect, the developing means, the squeezing means, and the vaporizing means are disposed at the position where the inside surface of the belt type developed image carrier does not contact firmly with the electrostatic latent image forming unit.

According to an eleventh aspect of the present invention, in the second aspect, the electrostatic latent image forming unit is disposed at the inside of the belt type developed image carrier.

According to a twelfth aspect of the present invention, in the second aspect, the liquid developer is an ink material that is fixed by melting by heat.

According to a thirteenth aspect of the present invention, in the second aspect, the liquid developer is an ink material that forms a film by reducing and removing the residual liquid developer.

According to a fourteenth aspect of the present invention, in the second aspect, the electrostatic latent image is developed by that the liquid developer in the developing means contacts with the belt type developed image carrier.

According to a fifteenth aspect of the present invention, in the second aspect, the latent image forming means is disposed at the position where the belt type developed image carrier contacts directly with the electrostatic latent image forming unit.

According to a sixteenth aspect of the present invention, in the second aspect, the latent image forming means is disposed at the position where the belt type developed image carrier does not contact directly with the electrostatic latent image forming unit.

According to a seventeenth aspect of the present invention, in the second aspect, the latent image forming means is disposed at the reverse side of the surface that the belt type developed image carrier contacts with the electrostatic latent image forming unit.

According to an eighteenth aspect of the present invention, in the seventeenth aspect, the belt type developed image carrier has transparency.

According to a nineteenth aspect of the present invention, in at the second aspect, the electrostatic latent image forming unit is a drum type.

According to a twentieth aspect of the present invention, in the second aspect, the electrostatic latent image forming unit is a belt type.

According to a twenty-first aspect of the present invention, in the second aspect, four of the image forming apparatus are disposed in parallel for forming a color image, and each developing unit in the four image forming apparatuses stores a yellow (Y), a magenta (M), a cyan (C), and a black (K) color liquid developer respectively, and the recording medium is passed through all of the four image forming apparatuses supported by transporting guides and transporting rollers disposed between each of the image forming apparatuses, and the color image is formed.

BRIEF DESCRIPTION OF THE DRAWINGS

The objective and features of the present invention will become more apparent from the consideration of the following detailed description taken in conjunction with the accompanying drawings in which.

DESCRIPTION OF THE PREFERRED EMBODIMENTS

Figure 1:
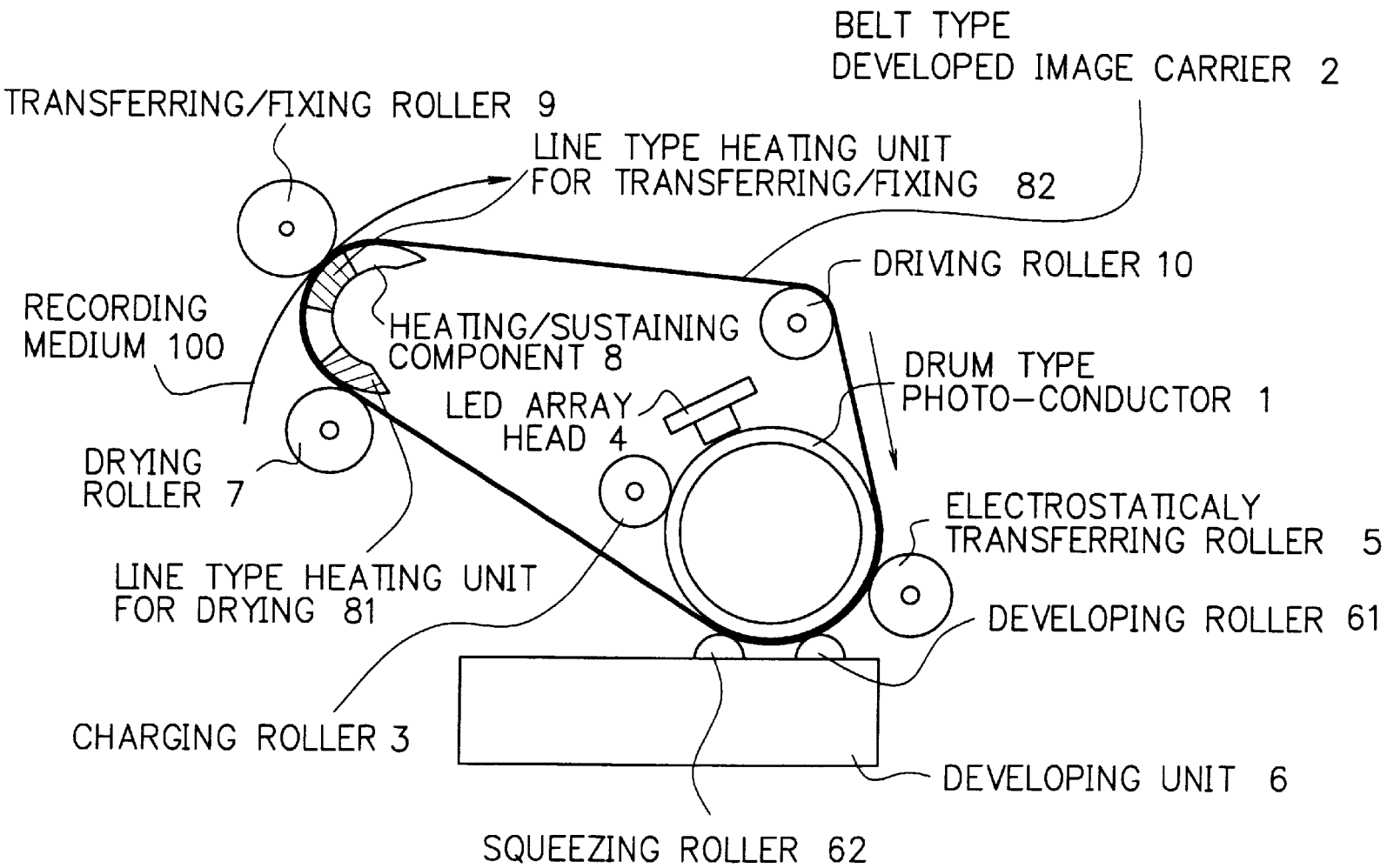
FIG. 1 is a diagram showing a structure of a first embodiment of an image forming apparatus used a liquid developer of the present invention.

Referring now to the drawings, embodiments of the present invention are explained in detail. FIG. 1 is a diagram showing a structure of a first embodiment of an image forming apparatus used a liquid developer of the present invention.

As shown in FIG. 1, the first embodiment of the image forming apparatus used the liquid developer of the present invention consists of a drum type photo-conductor 1, a belt type developed image carrier 2 which has a dielectric characteristic and rotates in a state that a part of the inside surface of the belt type developed image carrier 2 contacts firmly with the drum type photo-conductor 1, a charging roller 3 which charges the drum type photo-conductor 1, a light emitting diode (LED) array head 4 which exposes an image based on image information in order to form an electrostatic latent image on the surface of the charged drum type photo-conductor 1, an electrostatically transferring roller 5 which transfers electrostatically the electrostatic latent image formed on the drum type photo-conductor 1 to the belt type developed image carrier 2, a developing unit 6 which develops the electrostatic latent image transferred electrostatically to the belt type developed image carrier 2 at the outside surface of the belt type developed image carrier 2 by using a liquid developer, a drying roller 7 which removes a carrier solvent contained in the developed image formed on the belt type developed image carrier 2 by vaporizing the carrier solvent, a heating/sustaining component 8 which makes the developed image formed on the belt type developed image carrier 2 transfer and fix on a recording medium 100 by applying heat and pressure to the developed image, and also sustains the rotation of the belt type developed image carrier 2, a transferring/fixing roller 9 which works with the heating/sustaining component 8 to make the developed image fix on the recording medium 100 at the same time when the developed image is transferred to the recording medium 100 by making the recording medium 100 move and by pushing the recording medium 100 to the belt type developed image carrier 2, and a driving roller 10 which drives the belt type developed image carrier 2 in the arrow direction in FIG. 1.

At the structure mentioned above, the heating/sustaining component 8 provides a line type heating unit for drying 81 and a line type heating unit for transferring/fixing 82. In this, the line type heating unit for drying 81 faces the drying roller 7 and the line type heating unit for transferring/fixing 82 faces the transferring/fixing roller 9. And the developing unit 6 provides a developing roller 61 applied a developing bias voltage which transports the liquid developer to the belt type developed image carrier 2, and a squeezing roller 62 which squeezes a residual liquid developer transported to the belt type developed image carrier 2. The squeezing roller 62 contacts with the drum type photo-conductor 1 by pressure in a state that the belt type developed image carrier 2 is positioned between the squeezing roller 62 and the drum type photo-conductor 1. And the squeezing roller 62 is rotated by that the drum type photo-conductor 1 and the belt type developed image carrier 2 are driven. In this, the line type heating unit for transferring/fixing 82 in the heating/sustaining component 8 and the transferring/fixing roller 9 constitute a transferring/fixing section.

As the liquid developer used in the embodiment, a liquid developer in which particles, whose main constituent is a resin material melting/fixing by heat, such as, polyester, polystyrene, are dispersed, can be used. And also, an ink material, in which a film is formed by that a solvent is reduced and removed, can be used, the ink materials are mentioned in U.S. Pat. No. 5,650,253, and U.S. Pat. No. 5,698,616. In this, the ink material forming a film is a liquid developer in which micro substances such as micro toners having a glass transition temperature being lower than the room temperature are dispersed in the carrier solvent. And at a normal state, the micro substances are not condensed by contacting with one another, but when the carrier solvent is removed, the micro substances remain and turn into a film state by bonding like an adhesive at the room temperature. These micro substances can be obtained by compounding ethyl alcohol and methyl methacrylate, and the glass transition temperature can be set by its compounding ratio.

Next, operation of the first embodiment of the image forming apparatus used the liquid developer of the present invention is explained. First, a negative electric charge (−) is uniformly applied to the surface of the drum type photo-conductor 1 by the charging roller 3. The LED array head 4 forms an electrostatic latent image on the drum type photo-conductor 1 by exposing an image based on image information. The electrostatic latent image formed on the drum type photo-conductor 1 is transferred electrostatically to the belt type developed image carrier 2 by the electrostatically transferring roller 5 applied a positive electrostatic transferring bias voltage (+). At this time, the electrostatic latent image is transferred in a state that the drum type photo-conductor 1 and the belt type developed image carrier 2 moves by contacting firmly with each other, therefore, the electrostatic latent image is not distorted.

On the outside surface of the belt type developed image carrier 2 passed through the electrostatically transferring roller 5, a distribution of positive electric charges (+) is formed in response to a distribution of negative electric charges (−) being the electrostatic latent image formed on the drum type photo-conductor 1, this distribution of positive electric charges (+) is the electrostatic latent image to be developed.

At this time, after the electrostatic transferring, the voltage difference about 750 V between an image part (−100 V) and a non image part (−850 V) on the drum type photo-conductor 1 becomes an electric potential distribution of the voltage difference about 550 V between an image part (+150 V) and a non image part (+700 V) on the outside surface of the belt type developed image carrier 2.

At the developing unit 6, the electrostatic latent image formed on the outside surface of the belt type developed image carrier 2 is developed by the liquid developer transported by the developing roller 61 applied a developing bias voltage (+450V), and the developed image to which toners in the liquid developer adhered is formed at the image part of the belt type developed image carrier 2. And the residual liquid developer at the image and non image parts is squeezed out by the squeezing roller 62 contacted by pressure with the belt type developed image carrier 2. With this operation, at the image part on the belt type developed image carrier 2, a developed image layer is formed by a toner film that does not contain many amount of carrier solvents.

And heat and pressure are applied to the developed image layer on the belt type developed image carrier 2 by the drying roller 7 and the line type heating unit for drying 81 disposed in the heating/sustaining component 8 positioned inside the belt type developed image carrier 2. With this, the residual carrier solvent in the developed image layer is removed by vaporizing. Consequently, an image by the toner film, which does not contain the carrier solvent almost completely, is formed.

Further, heat and pressure are applied to the image, in which the carrier solvent is removed, on the belt type developed image carrier 2, at the transferring/fixing section composed of the transferring/fixing roller 9 and the line type heating unit for transferring/fixing 82 disposed in the heating/sustaining component 8. And an image is formed on the recording medium 100 such as a general-purpose paper by fixing at the same time of transferring.

The belt type developed image carrier 2 is passed through the transferring/fixing section composed of the transferring/fixing roller 9 and the line type heating unit for transferring/fixing 82 disposed in the heating/sustaining component 8, and the surface of the belt type developed image carrier 2 is cleaned by a cleaning unit (not shown). And the residual electric charges on the surface of the belt type developed image carrier 2 are removed by a discharger (not shown), and is used for the next image forming.

As mentioned above, at the first embodiment of the present invention, the liquid developer does not directly contact with the drum type photo-conductor 1. Therefore, the drum type photo-conductor 1 is not swelled by the liquid developer, and a low cost photo-conductor material using generally can be used for the drum type photo-conductor 1. And the swelling of the drum type photo-conductor 1 caused by the liquid developer dose not occur, therefore, a barrier layer to prevent that the liquid developer enters into the photo-conductor and swells the photo-conductor does not need. Further, a release layer, in which surface energy is made to be low so that the developed image formed on the surface by the liquid developer is made to transfer easily to a recording medium such as an intermediate transferring unit, or a sheet of paper, does not need. Consequently, the photo-conductor material can be further made to be low cost.

And the drying and transferring/fixing the developed image, which is performed by applying heat and pressure, are performed without any connection of the photo-conductor material, therefore, the heat characteristic of the photo-conductor material is not needed to consider especially. Consequently, a low cost photo-conductor material using generally can be used for the drum type photo-conductor 1.

From the effects mentioned above, the photo-conductor material can be used for a long time, and the running cost can be reduced. Further, generally a drum type photo-conductor can be easily replaced, compared with a belt type photo-conductor.

Further, at the time when the carrier solvent is removed almost completely from the developed image layer by drying at the drying roller 7, the drying is realized without any connection of the photo-conductor material. Therefore, the drying condition can be easily set up to an optimum condition, without considering the photo-conductor characteristic, such as preventing from swelling, having heat-resistant, and being a long life, and a suitable transferring/fixing can be realized.

Figure 2:
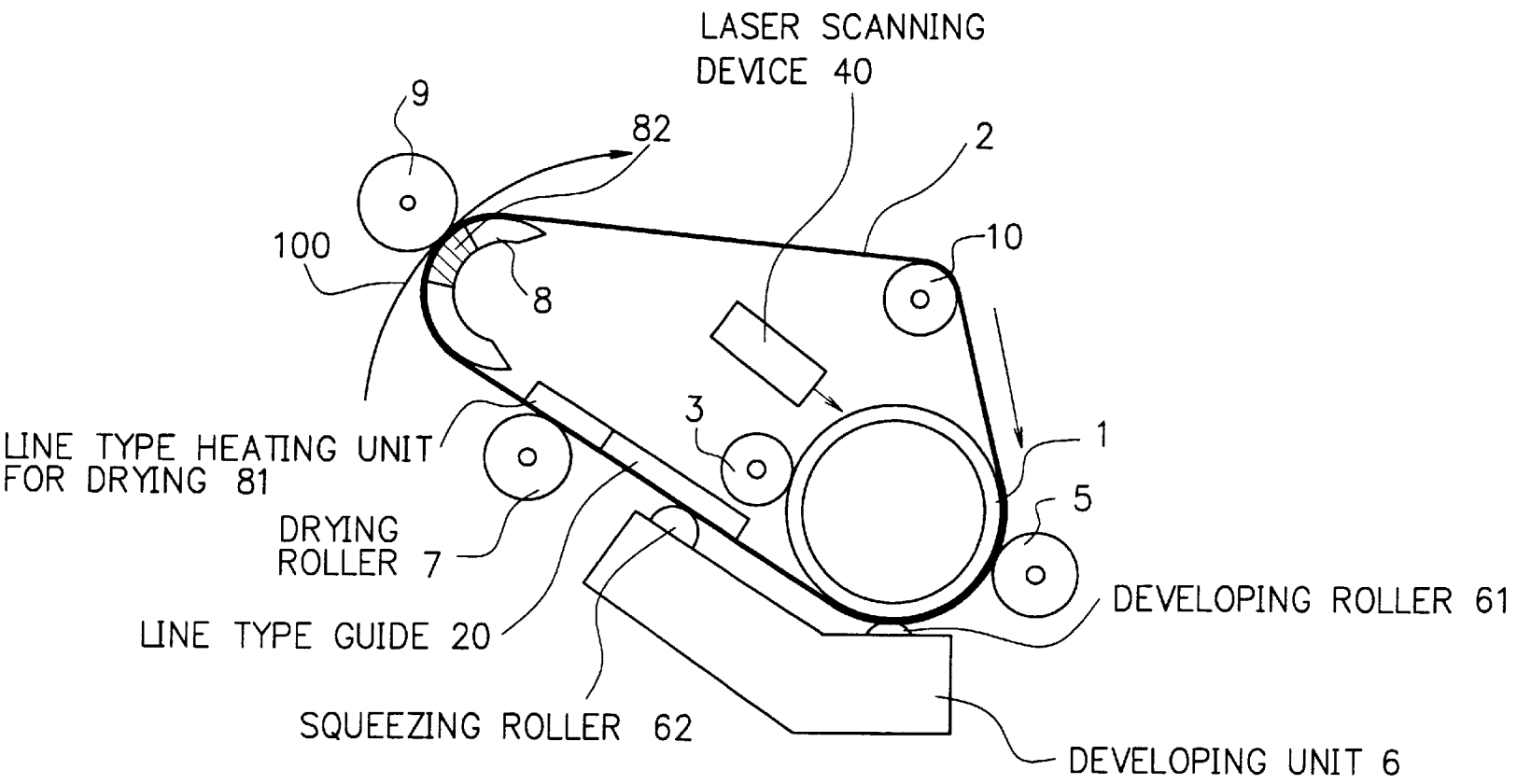
FIG. 2 is a diagram showing a structure of a second embodiment of the image forming apparatus used the liquid developer of the present invention.

Next, referring to a drawing, a second embodiment of the image forming apparatus used the liquid developer of the present invention is explained. FIG. 2 is a diagram showing a structure of the second embodiment of the image forming apparatus used the liquid developer of the present invention. At the second embodiment, functions equivalent to the first embodiment have the same reference numbers, and the explanation for the same functions is omitted.

As shown in FIG. 2, at the second embodiment, a laser scanning device 40 is provided instead of the LED array head 4 at the first embodiment. The laser scanning device 40 exposes an image on the drum type photo-conductor 1. Further, a line type guide 20 is newly provided. And the developing roller 61 is disposed at the position where the belt type developed image carrier 2 contacts firmly with the drum type photo-conductor 1, and the squeezing roller 62 is disposed at the position not firmly contacting the belt type developed image carrier 2 with the drum type photo-conductor 1. The line type guide 20 guides the squeezing roller 62. And the line type heating unit for drying 81 is separated from the heating/sustaining component 8 and is disposed at the position near the line type guide 20. And the drying roller 7 is disposed at the position facing the line type heating unit for drying 81. The shape of the developing unit 6 is changed to meet the disposition of the developing roller 61 and the squeezing roller 62.

Generally, since the pressure load applying to the drum type photo-conductor 1 from the squeezing roller 62 becomes the magnitude of kilogram, therefore, the pressure load is changed by the eccentricity of the drum type photo-conductor 1. In order to avoid this, at the second embodiment, the squeezing roller 62 is disposed at the position not firmly contacting the belt type developed image carrier 2 with the drum type photo-conductor 1. With this structure, the pressure load from the squeezing roller 62 to the drum type photo-conductor 1 does not occur, therefore, changing the pressure load caused by the eccentricity of the drum type photo-conductor 1 does not occur. Further, in order to form the electrostatic latent image, the laser scanning device 40 exposes the image, therefore, the high-density exposure and the uniformity of the exposing energy can be realized.

Figure 3:
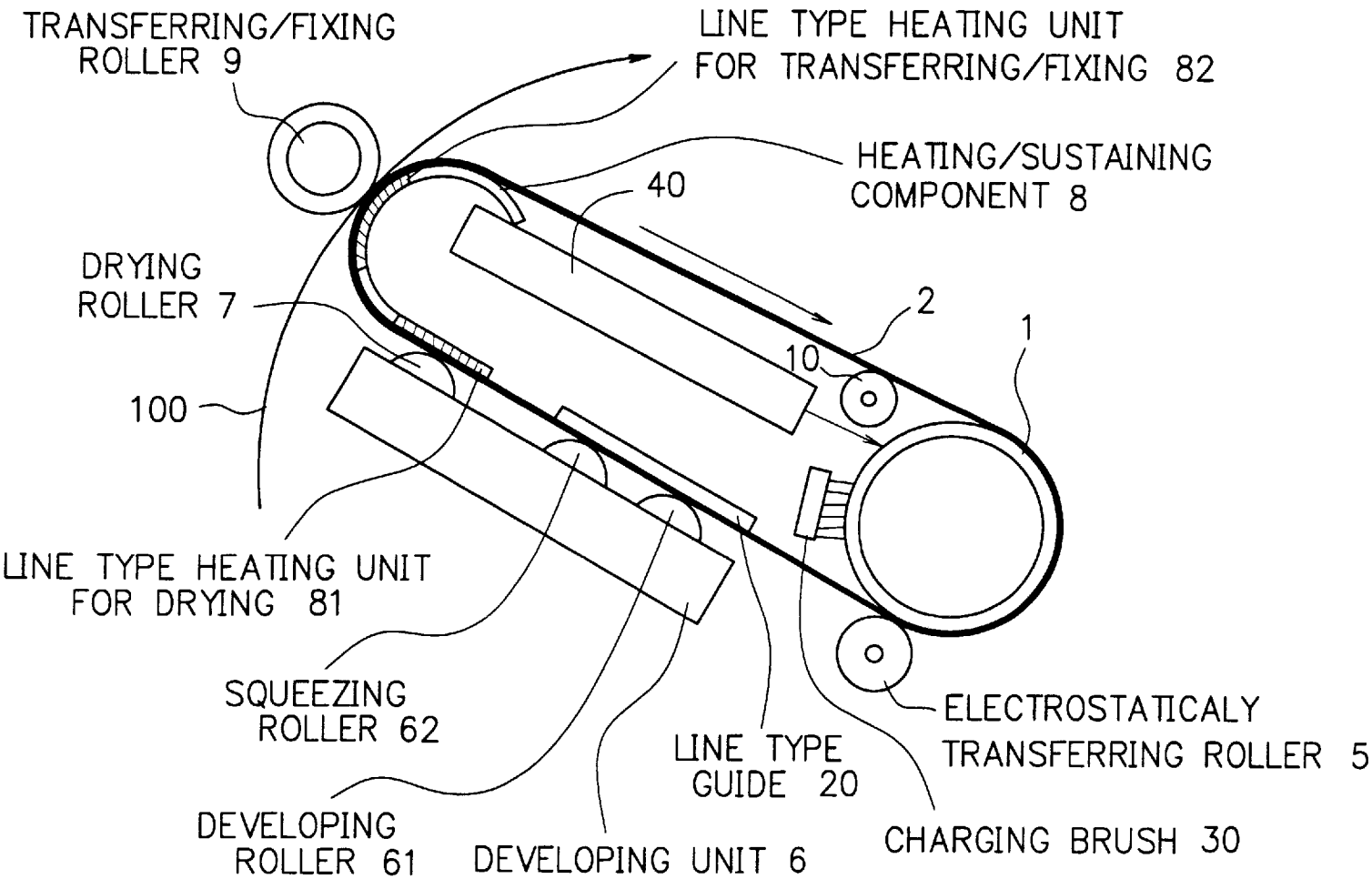
FIG. 3 is a diagram showing a structure of a third embodiment of the image forming apparatus used the liquid developer of the present invention.

Next, referring to a drawing, a third embodiment of the image forming apparatus used the liquid developer of the present invention is explained. FIG. 3 is a diagram showing a structure of the third embodiment of the image forming apparatus used the liquid developer of the present invention. At the third embodiment, functions equivalent to the first and second embodiments have the same reference numbers, and the explanation for the same functions is omitted.

As shown in FIG. 3, at the third embodiment, a charging brush 30 is provided instead of the charging roller 3 at the first and second embodiments. The charging brush 30 charges the drum type photo-conductor 1. And the developing roller 61, the squeezing roller 62, and the drying roller 7 are provided in the developing unit 6, and the shape of the developing unit 6 is changed. And the developing unit 6 is disposed at the position where the belt type developed image carrier 2 does not contact firmly with the drum type photo-conductor 1. And the line type guide 20 guides not only the squeezing roller 62 but also the developing roller 61. Further, the shape of the heating/sustaining component 8 is changed.

At the third embodiment, since the developing roller 61 and the squeezing roller 62 are disposed at the position where the belt type developed image carrier 2 does not contact firmly with the drum type photo-conductor 1, in addition to the effects of the first and second embodiments, further the image forming apparatus can be small sized. And since the developing roller 61 is disposed at the position where the developing roller 61 does not contact firmly with the drum type photo-conductor 1, the liquid developer does not enter into the drum type photo-conductor 1 from its sides.

Figure 4:
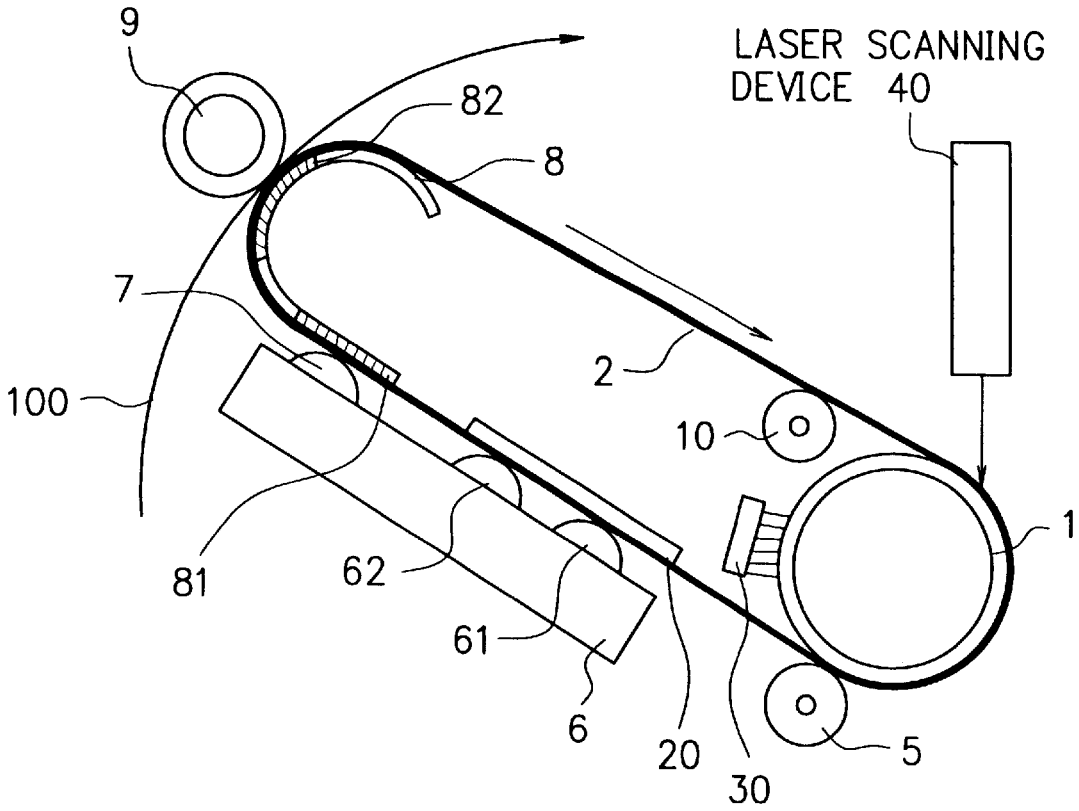
FIG. 4 is a diagram showing a structure of a fourth embodiment of the image forming apparatus used the liquid developer of the present invention.

Next, referring to a drawing, a forth embodiment of the image forming apparatus used the liquid developer of the present invention is explained. FIG. 4 is a diagram showing a structure of the fourth embodiment of the image forming apparatus used the liquid developer of the present invention. At the fourth embodiment, functions equivalent to the third embodiment have the same reference numbers, and the explanation for the same functions is omitted.

As shown in FIG. 4, at the fourth embodiment, the laser scanning device 40 is disposed at the outside of the belt type developed image carrier 2. The laser scanning device 40 occupies a relatively large space, therefore, the laser scanning device 40 is separated from an image forming section being a part of the image forming apparatus. In this, the electrostatic latent image is formed on the drum type photo-conductor 1 by the laser scanning device 40 positioned at the outside, therefore, the belt type developed image carrier 2 must have transparency. Therefore, at the fourth embodiment, a transparent belt type developed image carrier is used.

At the fourth embodiment, the laser scanning device 40, which occupies the relatively large space, is separated from the image forming section and is disposed at the outside of the image forming section. Therefore, at the time when some maintenance, inspection, or repair is needed for a part of the apparatus, each action can be applied to each section of the total apparatus. Consequently, the total apparatus can be easily maintained in good condition. Further, the laser scanning device 40 is disposed at the outside of the image forming section, the image forming section can be small sized. In addition to this, manufacturing the apparatus becomes easy by separating the sections, therefore, it is possible to reduce the manufacturing cost.

At the fourth embodiment, the laser scanning device 40 is used as an image exposing means, however, the LED array head 4 used at the first embodiment can be used.

Figure 5:
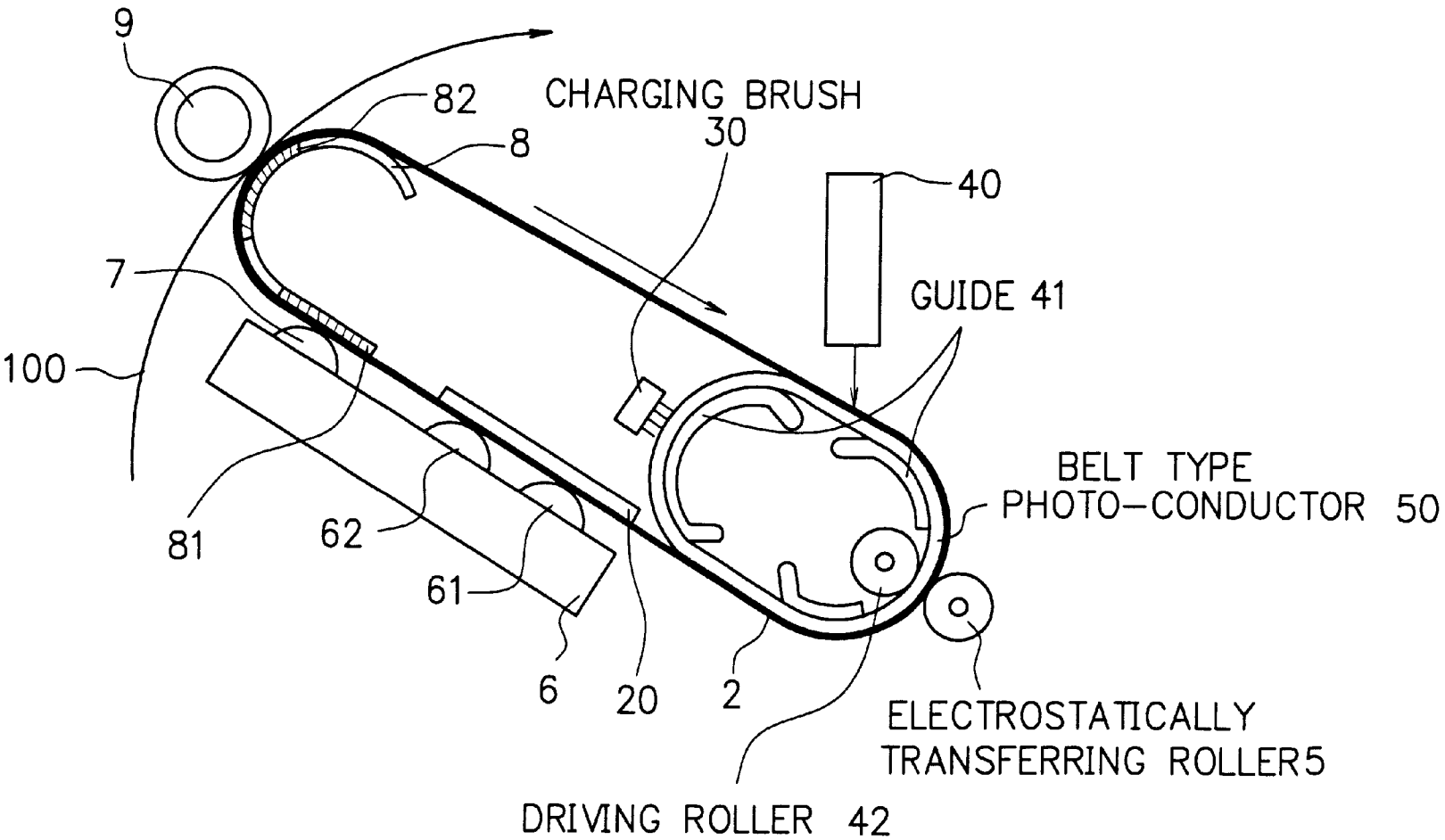
FIG. 5 is a diagram showing a structure of a fifth embodiment of the image forming apparatus used the liquid developer of the present invention.

Next, referring to a drawing, a fifth embodiment of the image forming apparatus used the liquid developer of the present invention is explained. FIG. 5 is a diagram showing a structure of the fifth embodiment of the image forming apparatus used the liquid developer of the present invention. At the fifth embodiment, functions equivalent to the fourth embodiment have the same reference numbers, and the explanation for the same functions is omitted.

As shown in FIG. 5, at the fifth embodiment, a belt type photo-conductor 50 is provided instead of the drum type photo-conductor 1 at the fourth embodiment. Further, a guide 41 for guiding the rotation of the belt type photo-conductor 50 is newly provided and a driving roller 42 for rotating the belt type photo-conductor 50 instead of the driving roller 10 at the fourth embodiment is provided.

At the fifth embodiment, the photo-conductor is a belt type, as a result, the area, which the belt type photo-conductor 50 contacts firmly with the inside surface of the belt type developed image carrier 2, becomes large. Therefore, the degree of freedom for disposing each unit or component composing the apparatus can be made to be large.

Figure 6:
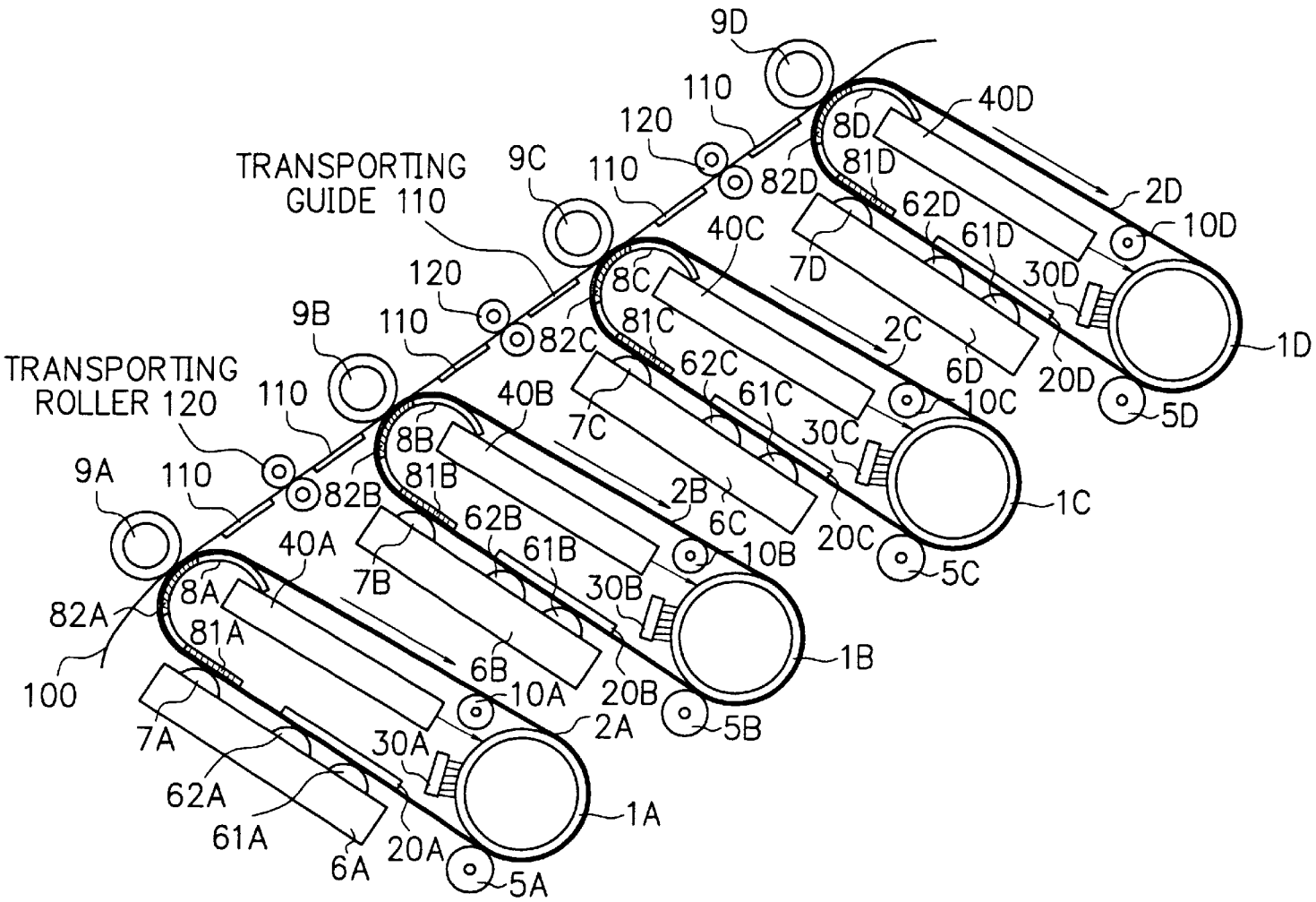
FIG. 6 is a diagram showing a structure of a sixth embodiment of the image forming apparatus used the liquid developer of the present invention.

Next, referring to a drawing, a sixth embodiment of the image forming apparatus used the liquid developer of the present invention is explained. FIG. 6 is a diagram showing a structure of the sixth embodiment of the image forming apparatus used the liquid developer of the present invention. At the sixth embodiment, the image forming apparatus is applied to form a color image and a plurality of the image forming apparatuses are connected, therefore, the reference number of each function has a letter(s) added to the original reference number in each of the image forming apparatuses. Therefore, the functions equivalent to the third embodiment have the same reference numbers without the added alphabets, accordingly, the explanation for the same functions is omitted. As shown in FIG. 6, at the sixth embodiment, four of the image forming apparatus of the third embodiment are disposed in parallel. And a yellow (Y) liquid developer is stored in a developing unit 6A, a magenta (M) liquid developer is stored in a developing unit 6B, a cyan (C) liquid developer is stored in a developing unit 6C, and a black (K) liquid developer is stored in a developing unit 6D. And the sixth embodiment of the present invention provides transporting guides 110 for guiding the recording medium 100 for the time when the recording medium 100 is transported to the next image forming apparatus, and transporting rollers 120 for transporting the recording medium 100 to the next image forming apparatus.

Next, operation of the sixth embodiment of the image forming in apparatus used the liquid developer of the present invention is explained. A developed image formed on the belt type developed image carrier 2A at the developing unit 6A is heated and pressured at the line type heating unit for transferring/fixing 82A and the transferring/fixing roller 9A, and a Y image is formed on the recording medium 100. The recording medium 100 on which the Y image is formed is transported to the next image forming apparatus by the transporting guides 110 and the transporting rollers 120. At the next image forming apparatus, a developed image formed on the belt type developed image carrier 2B at the developing unit 6B is heated and pressured at the line type heating unit for transferring/fixing 82B and the transferring/fixing roller 9B, and an M image is additionally formed on the recording medium 100. The recording medium 100 on which the Y and M images are formed is transported to the next image forming apparatus by the transporting guides 110 and the transporting rollers 120. At the next image forming apparatus, a developed image formed on the belt type developed image carrier 2C at the developing unit 6C is heated and pressured at the line type heating unit for transferring/fixing 82C and the transferring/fixing roller 9C, and a C image is additionally formed on the recording medium 100. The recording medium 100 on which the Y, M and C images are formed is transported to the next image forming apparatus by the transporting guides 110 and the transporting rollers 120. At the next image forming apparatus, a developed image formed on the belt type developed image carrier 2D at the developing unit 6D is heated and pressured at the line type heating unit for transferring/fixing 82D and the transferring/fixing roller 9D, and a K image is additionally formed on the recording medium 100. The recording medium 100 on which the Y, M, C, and K images are formed is transported to the outside of the image forming apparatus by the transporting guides 110 and the transporting rollers 120. And the color image formed by the operation mentioned above is outputted.

As mentioned above, at the sixth embodiment, four liquid developers in response to YMCK colors are provided. Therefore, in addition to the effects of the third embodiment, a color image can be formed.

At the embodiments mentioned above, a line type heating unit is used for drying, and transferring/fixing the developed image. However, as the heating unit, it is not limited to this line type heating unit, a roller having a heating unit inside the roller can be used. And a transferring/fixing roller is used for transferring and fixing the developed image to a recording medium, however, in order to respond to a high speed output, a heated roller can be used. Further, a charging roller or a charging brush is used for charging a drum or belt type photo-conductor, however, charging can be performed by a corona charger and a residual electric charge can be removed by a corona discharger.

As mentioned above, according to the present invention, an electrostatic latent image is transferred to a belt type developed image carrier which rotates in a state that a part of the inside of the belt type developed image carrier contacts firmly with an electrostatic latent image forming unit, and the electrostatic latent image transferred on the belt type developed image carrier is developed by using a liquid developer. Therefore, without considering a swelling of the photo-conductor material caused by the liquid developer and a heat characteristic of the photo-conductor material, a conventional photo-conductor can be used, and the running cost can be also reduced, and further the photo-conductor can be used for a long time. In addition to the effects mentioned above, even using the liquid developer, designing of image forming processes becomes easy, therefore, the total cost of the image forming apparatus becomes low. And a high-resolution and high-quality image developed by the liquid developer can be outputted in stable.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. An image forming apparatus using a liquid developer, comprising:

an electrostatic latent image forming unit;

a transfer unit for transferring said electrostatic latent image from said forming unit, said transfer unit comprising a substantially dry, rotatable belt type developed image carrier which rotates such that a dry part of the inside surface of said belt type developed image carrier contacts firmly with said latent image forming unit, whereby said electrostatic latent image is transferred to said belt type developed image carrier from said electrostatic latent image forming unit;

a developer for developing said electrostatic latent image transferred on said belt type developed image carrier, said developer comprising a liquid developer; and a heater for removing residual liquid developer from said belt and supporting the rotation of said belt after developing said latent image.

2. An image forming apparatus using a liquid developer comprising:

an electrostatic latent image forming unit;

charging means for charging said electrostatic latent image forming unit;

latent image forming means for forming an electrostatic latent image on said electrostatic latent image forming unit;

a rotatable belt type developed image carrier which rotates such that a substantially dry part of the inside surface of said belt type developed image carrier contacts firmly with said latent image forming unit;

electrostatically image transferring means for electrostatically transferring said electrostatic latent image formed on said electrostatic latent image forming unit to said belt type developed image carrier;

liquid developing means for developing said electrostatic latent image transferred on said belt type developed image carrier by electrostatically transporting said liquid developer to a portion of the exterior surface of said belt type developed image carrier;

squeezing means for squeezing a residual liquid developer from said developed image on said belt type developed image carrier by applying pressure;

vaporizing means for vaporizing said residual liquid developer contained in said developed image on said belt type developed image carrier by applying heat and pressure in contact with a portion of the exterior surface of said belt type developed image carrier; and transferring/fixing means, in contact with said belt, for transferring and fixing on a recording medium said developed image after said residual liquid developer was squeezed and vaporized; and a heater for removing residual liquid developer from said belt and supporting the rotation of said belt after developing said latent image.

3. An image forming apparatus using a liquid developer in accordance with claim 2, wherein:

said vaporizing means provides a heating unit for applying heat and a drying roller for applying pressure, and said heating unit faces said drying roller by having said belt type developed image carrier between them.

4. An image forming apparatus using a liquid developer in accordance with claim 2, wherein:

said transferring/fixing means provides a heating unit for applying heat and a transferring/fixing roller for applying pressure, and said heating unit faces said transferring/fixing roller by having said belt type developed image carrier between them.

5. An image forming apparatus using a liquid developer in accordance with claim 2, further comprising:

a heating/sustaining component which provides said heating unit for said transferring/fixing means and also sustains the rotation of said belt type developed image carrier.

6. An image forming apparatus using a liquid developer in accordance with claim 2, wherein:

said developing means develops said electrostatic latent image formed on said belt type developed image carrier at the reverse surface of the surface that said belt type developed image carrier contacts with said electrostatic latent image forming unit.

7. An image forming apparatus using a liquid developer in accordance with claim 2, wherein:

said electrostatic latent image forming unit is disposed at the inside of said belt type developed image carrier.

8. An image forming apparatus using a liquid developer in accordance with claim 2, wherein:

said liquid developer comprises an ink material that is fixed by melting by heat.

9. An image forming apparatus using a liquid developer in accordance with claim 2, wherein:

said liquid developer comprises an ink material that forms a film by reducing and removing said residual liquid developer.

10. An image forming apparatus using a liquid developer in accordance with claim 2, wherein:

said electrostatic latent image is developed by said liquid developer in said developing means contacting with said belt type developed image carrier.

11. An image forming apparatus using a liquid developer in accordance with claim 2, wherein:

said latent image forming means is disposed at the position where said belt type developed image carrier does not contact directly with said electrostatic latent image forming unit.

12. An image forming apparatus using a liquid developer in accordance with claim 2, wherein:

said latent image forming means is disposed at the reverse side of the surface that said belt type developed image carrier contacts with said electrostatic latent image forming unit.

13. An image forming apparatus using a liquid developer in accordance with claim 2, wherein:

said electrostatic latent image forming unit comprises a drum type.

14. An image forming apparatus using a liquid developer in accordance with claim 2, wherein:

said electrostatic latent image forming unit comprises a belt type.

15. An image forming apparatus using a liquid developer in accordance with claim 2, wherein:

four of said image forming apparatus are disposed in parallel for forming a color image, and each developing unit in said four image forming apparatuses stores a yellow (Y), a magenta (M), a cyan (C), and a black (K) color liquid developer respectively, and said recording medium is passed through all of said four image forming apparatuses supported by transporting guides and transporting rollers disposed between each of said image forming apparatuses, and said color image is formed.

16. An image forming apparatus using a liquid developer comprising:

an electrostatic latent image forming unit;

charging means for charging said electrostatic latent image forming unit;

latent image forming means for forming an electrostatic latent image on said electrostatic latent image forming unit;

a belt type developed image carrier which rotates such that a part of the inside surface of said belt type developed image carrier contacts firmly with said latent image forming unit;

electrostatically image transferring means for electrostatically transferring said electrostatic latent image formed on said electrostatic latent image forming unit to said belt type developed image carrier;

developing means for developing said electrostatic latent image transferred on said belt type developed image carrier by transporting a liquid developer to said belt type developed image carrier;

squeezing means for squeezing a residual liquid developer from said developed image on said belt type developed image carrier by applying pressure;

vaporizing means for vaporizing said residual liquid developer contained in said developed image on said belt We developed image carrier by applying heat and pressure;

transferring/fixing means for transferring and fixing on a recording medium said developed image whose said residual liquid developer was squeezed and vaporized; and a heating/sustaining component which provides a heating unit in said vaporizing means and said heating unit for said transferring/fixing means and also sustains the rotation of said belt type developed image carrier.

17. An image forming apparatus using a liquid developer comprising:

an electrostatic latent image forming unit;

charging means for charging said electrostatic latent image forming unit;

latent image forming means for forming an electrostatic latent image on said electrostatic latent image forming unit;

a belt type developed image carrier which rotates such that a part of the inside surface of said belt type developed image carrier contacts firmly with said latent image forming unit;

electrostatically image transferring means for electrostatically transferring said electrostatic latent image formed on said electrostatic latent image forming unit to said belt type developed image carrier;

developing means for developing said electrostatic latent image transferred on said belt tape developed image carrier by transporting a liquid developer to said belt type developed image carrier;

squeezing means for squeezing a residual liquid developer from said developed image on said belt type developed image carrier by applying pressure;

vaporizing means for vaporizing said residual liquid developer contained in said developed image on said belt type developed image carrier by applying heat and pressure; and transferring/fixing means for transferring and fixing on a recording medium said developed image whose said residual liquid developer was squeezed and vaporized;

wherein said developing means and said squeezing means are disposed at the position where the inside surface of said belt type developed image carrier contacts firmly with said electrostatic latent image forming unit; and said vaporizing means is disposed at the position where the inside surface of said belt type developed image carrier does not contact firmly with said electrostatic latent image forming unit.

18. An image forming apparatus using a liquid developer comprising:

an electrostatic latent image forming unit;

charging means for charging said electrostatic latent image forming unit;

latent image forming means for forming an electrostatic latent image on said electrostatic latent image forming unit;

a belt type developed image carrier which rotates such that a part of the inside surface of said belt type developed image carrier contacts firmly with said latent image forming unit;

electrostatically image transferring means for electrostatically transferring said electrostatic latent image formed on said electrostatic latent image forming unit to said belt type developed image carrier;

developing means for developing said electrostatic latent image transferred on said belt type developed image carrier by transporting a liquid developer to said belt type developed image carrier;

squeezing means for squeezing a residual liquid developer from said developed image on said belt type developed image carrier by applying pressure;

vaporizing means for vaporizing said residual liquid developer contained in said developed image on said belt type developed image carrier by applying heat and pressure; and transferring/fixing means for transferring and fixing on a recording medium said developed image whose said residual liquid developer was squeezed and vaporized, wherein said developing means is disposed at the position where the inside surface of said belt type developed image carrier contacts firmly with said electrostatic latent image forming unit, and said squeezing means and said vaporizing means are disposed at the position where the inside surface of said belt type developed image carrier does not contact firmly with said electrostatic latent image forming unit.

19. An image forming apparatus using a liquid developer comprising:

an electrostatic latent image forming unit;

charging means for charging said electrostatic latent image forming unit;

latent image forming means for forming an electrostatic latent image on said electrostatic latent image forming unit;

a belt type developed image carrier which rotates such that a part of the inside surface of said belt type developed image contacts firmly with said latent image forming unit;

electrostatically image transferring means for electrostatically transferring said electrostatic latent image formed on said electrostatic latent image forming unit to said belt type developed image carrier;

developing means for developing said electrostatic latent image transferred on said belt type developed image carrier by transporting a liquid developer to said belt type developed image carrier;

squeezing means for squeezing a residual liquid developer from said developed image on said belt tape developed image carrier by applying pressure;

vaporizing means for vaporizing said residual liquid developer contained in said developed image on said belt type developed image carrier by applying heat and pressure; and transferring/fixing means for transferring and fixing on a recording medium said developed image whose said residual liquid developer was squeezed and vaporized, wherein said developing means, said squeezing means, and said vaporizing means are disposed at the position where the inside surface of said belt type developed image carrier does not contact firmly with said electrostatic latent image forming unit.

20. An image forming apparatus using a liquid developer comprising:

an electrostatic latent image forming unit;

charging means for charging said electrostatic latent image forming unit;

latent image forming means for forming an electrostatic latent image on said electrostatic latent image forming unit;

a belt type developed image carrier which rotates such that a part of the inside surface of said belt type developed image contacts firmly with said latent image forming unit;

electrostatically image transferring means for electrostatically transferring said electrostatic latent image formed on said electrostatic latent image forming unit to said belt type developed image carrier;

developing means for developing said electrostatic latent image transferred on said belt type developed image carrier by transporting a liquid developer to said belt type developed image carrier;

squeezing means for squeezing a residual liquid developer from said developed image on said belt type developed image carrier by applying pressure;

vaporizing means for vaporizing said residual liquid developer contained in said developed image on said belt type developed image carrier by applying heat and pressure; and transferring/fixing means for transferring and fixing on a recording medium said developed image whose said residual liquid developer was squeezed and vaporized, wherein said latent image forming means is disposed at the position where said belt type developed image carrier contacts directly with said electrostatic latent image forming unit.

21. An image forming apparatus using a liquid developer comprising:

an electrostatic latent image forming unit;

charging means for charging said electrostatic latent image forming unit;

latent image forming means for forming an electrostatic latent image on said electrostatic latent image forming unit;

a belt type developed image carrier which rotates such that a part of the inside surface of said belt type developed image contacts firmly with said latent image forming unit;

electrostatically image transferring means for electrostatically transferring said electrostatic latent image formed on said electrostatic latent image forming unit to said belt type developed image carrier;

developing means for developing said electrostatic latent image transferred on said belt type developed image carrier by transporting a liquid developer to said belt type developed image carrier;

squeezing means for squeezing a residual liquid developer from said developed image on said belt type developed image carrier by applying pressure;

vaporizing means for vaporizing said residual liquid developer contained in said developed image on said belt type developed image carrier be applying heat and pressure; and transferring/fixing means for transferring and fixing on a recording medium said developed image whose said residual liquid developer was squeezed and vaporized, wherein said latent image forming means is disposed at the reverse side of the surface that said belt type developed image carrier contacts with said electrostatic latent image forming unit and wherein said belt type developed image carrier has transparency.

* * * * *